US006436621B1

(12) United States Patent
Andriessen et al.

(10) Patent No.: US 6,436,621 B1
(45) Date of Patent: Aug. 20, 2002

(54) MULTILAYER SILVER HALIDE PHOTOGRAPHIC MATERIAL AND PROCESS FOR PREPARING THE SAME

(75) Inventors: Hieronymus Andriessen, Beerse; Freddy Henderickx, Olen, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 10/078,439

(22) Filed: Feb. 21, 2002

Related U.S. Application Data

(63) Continuation of application No. 08/715,593, filed on Sep. 18, 1996, now abandoned.
(60) Provisional application No. 60/007,925, filed on Dec. 4, 1995.

(30) Foreign Application Priority Data

Oct. 25, 1995 (EP) ..... 95202897

(51) Int. Cl.[7] ..... G03C 1/46; G03C 1/035; G03C 5/16

(52) U.S. Cl. ..... 430/509; 430/502; 430/965; 430/966

(58) Field of Search ..... 430/502, 509, 430/965, 966

(56) References Cited

U.S. PATENT DOCUMENTS

| | | | | | |
|---|---|---|---|---|---|
| 4,399,215 | A | * | 8/1983 | Wey | 430/567 |
| 4,425,426 | A | * | 1/1984 | Abbott et al. | 430/567 |
| 4,439,520 | A | * | 3/1984 | Kofron et al. | 430/502 |
| 4,585,729 | A | * | 4/1986 | Sugimoto et al. | 430/509 |
| 4,686,176 | A | * | 8/1987 | Yagi et al. | 430/506 |

* cited by examiner

*Primary Examiner*—Richard L. Schilling
(74) *Attorney, Agent, or Firm*—Breiner & Breiner, L.L.C.

(57) ABSTRACT

A multilayer light-sensitive silver halide photographic negative image type material and a method to prepare said material has been described, said material comprising on at least one side of a support a multilayer composition of at least two layers of negative image type silver halide emulsions adjacent to each other, wherein the emulsion layer closest to the said support comprises tabular emulsion crystals selected from the group consisting of silver chloride, silver chlorobromide, silver chloroiodide and silver chlorobromoiodide having a {111} crystal habit and silver chloride, silver chlorobromide, silver chloroiodide and silver chlorobromoiodide having a {100} crystal habit and wherein the adjacent layer(s) farther from the said support comprise(s) essentially cubic emulsion crystals selected from the group consisting of silver chloride, silver chlorobromide and silver bromide, wherein the essentially cubic grains are less sensitive than the tabular grains and wherein the said tabular emulsion crystals having {111} or {100} major faces have at least 50 mole % of chloride.

10 Claims, No Drawings

MULTILAYER SILVER HALIDE PHOTOGRAPHIC MATERIAL AND PROCESS FOR PREPARING THE SAME

This is a continuation of application Ser. No. 08/715,593 filed Sep. 18, 1996 now abandoned, which in turn claims benefit of U.S. provisional Serial No. 60/007,925 filed Dec. 4, 1995.

DESCRIPTION

1. Field of the Invention

The present invention relates to a light-sensitive silver halide photographic material having a multilayer composition of light-sensitive silver halide emulsion layers comprising negative image type tabular grain emulsions and the method to prepare said material.

2. Background and Object of the Invention

Light-sensitive silver halide photographic materials comprising silver halide emulsion layers having negative image type tabular grain emulsions have become more and more important during the last decade.

Tabular silver halide grains are crystals possessing two parallel faces with a ratio between the diameter of a circle having the same area as these faces, and the thickness, being the distance between the two major faces, equal to at least 2.

Tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72. Early patent literature includes Bogg, U.S. Pat. No. 4,063,951, Lewis U.S. Pat. No. 4,067,739 and Maternaghan U.S. Pat. Nos. 4,150,994; 4,184,877 and 4,184,878. However the tabular grains described therein cannot be regarded as showing a high diameter to thickness ratio, commonly termed aspect ratio. In a number of U.S. Patent Applications filed in 1981 and issued in 1984 tabular grains with high aspect ratio and their advantages in photographic applications are described. So Wilgus U.S. Pat. No. 4,434,226 discloses tabular silver bromoiodide grains having a thickness of less than 0.2 $\mu$m, a diameter of at least 0.6 $\mu$m and an average aspect ratio greater than 8:1 and accounting for at least 50 percent of the total projected area of all the emulsion grains. Kofron U.S. Pat. No. 4,439,520 discloses similar grains which are spectrally sensitized. Abbott U.S. Pat. No. 4,425,425 describes radiographic materials containing tabular grains with an aspect ratio of at least 8:1 and Abbott U.S. Pat. No. 4,425,426 discloses similar grains with an aspect ratio between 5:1 and 8:1. A survey on high aspect ratio silver halide emulsions appeared in Research Disclosure, Volume 225, January 1983, Item 22534.

For radiographic applications the main photographic advantages of tabular grains compared to normal globular grains are a high covering power at high forehardening levels, a high developability and higher sharpness, especially in double side coated spectrally sensitized materials. The thinner the tabular grains the greater these advantages.

In the references on tabular grains cited above especially silver bromide or silver iodobromide emulsions having a high sensitivity are disclosed whereas the use of e.g. emulsions with tabular grains rich in chloride has hitherto been considered to be disadvantageous with respect to sensitivity. For emulsions with crystals rich in chloride, applications in the field of less sensitive materials as e.g. graphic arts materials, duplicating materials, radiographic hardcopy materials, diffusion transfer reversal materials and black-and-white or color print materials are well-known. The advantages of said emulsions with crystals rich in chloride regarding higher development and fixing rates, are highly appreciated.

As nowadays the tendency is present to get materials processed in shorter processing times, it is highly appreciated to combine said advantages with a high sensitivity for application in high-sensitive materials, an object which can be realized as has been described in EP-A 0 678 772.

In spite of these important advantages, tabular grains, those rich in chloride as well as those rich in bromide, have two important disadvantages: they are highly susceptible to mechanical stress and the developed silver has an unacceptable reddish-brown color if compared with the desired cold-black color shown by more globular grains. Tabular grains rich in silver chloride even show a worse image tone than those rich in bromide having comparable dimensions (thickness and aspect ratio) after processing in classical processing solutions used in the processing of classical radiological materials.

This reddish-brown color can be corrected by increasing the optical density in the red region of the visible spectrum by adding suitable dyes to the undercoat layer, to the emulsion layer and/or to the protective layer. This non-image wise color correction method has been disclosed in references as e.g. JP-A's 03 100 645; 01 029 838; 01 312 536; 03 103 846; 03 094 249; 03 255 435; 61 285 445; EP-B 271 309 and U.S. Pat. No. 4,861,702. But this inevitably leads to an undesirable higher gross-fog of the photographic material and obviously the sensitivity to mechanical stress is not improved by this optical correction method.

A more suitable way consists in an image-wise color correction. This can be made by making use of color-forming developers, which are colored blue in their oxidized form. Examples thereof are summarized in JP-A's 03 153 234; 03 154 043; 03 154 046. In JP-A's 03 156 447 and 03 157 645 the adsorption of a blue colored dye as a function of exposure has further been disclosed.

Another way to overcome these disadvantages is to use tabular grains with an increased thickness. Methods to prepare thicker tabular grains have already been described in U.S. Pat. Nos. 4,801,522; 5,028,521 and 5,013,641 and EP-A 0 569 075. However the advantages obtained by making use of tabular grains as cited above disappear by making use of this method.

Therefore it is an object of this invention to prepare tabular grains having a thickness less than 0.2 $\mu$m and to coat them in a negative image type silver halide photographic material, overcoming the above disadvantages of unacceptable image tone and susceptibility to mechanical stress. Other objects will become apparent from the description hereinafter.

SUMMARY OF THE INVENTION

The objects of the present invention are attained by providing a multilayer negative image type material comprising on at least one side of a support a multilayer composition of at least two layers of negative image type silver halide emulsions adjacent to each other, wherein the emulsion layer closest to the said support comprises tabular emulsion crystals selected from the group consisting of silver chloride, silver chlorobromide, silver chloroiodide, silver chlorobromoiodide, having a {111} or {100} crystal habit and wherein the adjacent layer(s) farther from the said support comprise(s) essentially cubic emulsion crystals selected from the group consisting of silver chloride, silver chlorobromide and silver bromide, wherein the essentially cubic grains are less sensitive than the tabular grains and wherein the said tabular emulsion crystals having {111} or {100} major faces have at least 50 mole % of chloride.

Moreover a method has been described for preparing said light-sensitive silver halide photographic negative image type material by the steps of coating said multilayer composition on at least one side of a support and overcoating said composition(s) with at least one protective layer.

DETAILED DESCRIPTION OF THE INVENTION

Preferably in the preparation step of the silver halide crystals selected from the group consisting of silver chloride, silver chlorobromide and silver bromide for use in the layer(s) adjacent to the layer(s) containing tabular {100} or {111} grains in the multilayer material according to this invention, the pAg range for the precipitation thereof is chosen such that the said emulsions coated in the emulsion layer farthest from the support are emulsions having essentially cubic crystal habit. By "essentially cubic" is meant a grain which either is (a) perfectly cubic, or (b) cubic with rounded corners, or (c) cubic with small (111) faces on the corners so that in fact a tetradecahedrical emulsion is obtained, the total area of these (111) faces however being small compared to the total area of the (100) faces. Moreover a cubo-octahedral shape is not excluded and depends on the effective pAg values applied during the precipitation of the said selected silver chloride, silver chlorobromide or silver bromide crystals.

The precipitation of such cubic crystals can be principally performed by one double jet step; alternatively it can consist of a sequence of a nucleation step and at least one growth step. In the latter case, of the total silver halide precipitated preferably 0.5% to 5.0 mole % is formed during said nucleation step which preferably consists of an approximately equimolecular addition of silver and halide salts. The rest of the silver and halide salts is then added during one or more consecutive double jet growth steps. The different steps of the precipitation can be alternated by physical ripening steps. During the growth step(s) the flow rate of the silver salt and halide solutions can be kept constant alternatively an increasing flow rate of silver salt and halide ion solutions can be established e.g. a linearly increasing flow rate. Typically the flow rate at the end is about 3 to 5 times greater then at the start of the growth step. These flow rates can be monitored by e.g. magnetic valves.

In a preferred embodiment of the present invention the essentially cubic emulsion is formed simply by one double jet step at a pAg maintained at a constant value between 7 and 10, and more preferably between 7 and 9, without separate nucleation step and at a constant flow rate. The constant pAg is realized by the use of a so-called "bypass solution" the addition of which is alternatingly switched on and off. The concentrations of the main silver salt and halide solutions typically range between 0.5 and 3 molar, and most preferably between 1 and 2 molar.

Preferably crystals of the essentially cubic emulsion have an average crystal diameter of from 0.1 to 0.8 $\mu$m and still more preferably from 0.2 to 0.6 $\mu$m.

Silver halide crystals used in the light-sensitive layer more close to the support of the multilayer material, prepared according to this invention, are thin tabular silver chlorobromide, silver chlorobromoiodide or silver chloroiodide emulsions comprising grains rich in chloride, having at least 50 mole % of chloride, more preferably at least 75 mole % of chloride and from 0.1 mole % up to 3 mole % of iodide if iodide is present.

The halide distribution in the tabular grains can be homogenous over the whole crystal volume. When phases differing in silver halide composition are present over the crystal volume said crystal is said to have a core-shell structure. More than one shell can be present and between different phases it can be recommended to have a phase enriched in silver iodide by applying the so-called conversion technique during preparation. Iodide ions can be provided by using aqueous solutions of inorganic salts thereof as e.g. potassium iodide, sodium iodide or ammonium iodide. Iodide ions can also be is provided by organic compounds releasing iodide ions as has e.g. been described in EP-A's 0 561 415, 0 563 701, 0 563 708, 0 649 052 and 0 651 284. Thin tabular grains, bounded by {100} or {111} major faces, are used in the hydrophilic emulsion layer of adjacent layers situated more-close to the support of the materials prepared according to this invention.

More specifically tabular silver halide grains rich in chloride, bounded by {100} major faces and/or the preparation method thereof and/or materials in which said grains can be incorporated have been described in e.g. U.S. Pat. Nos. 5,024,931; 5,264,337; 5,275,930; 5,292,632; 5,310,635; 5,314,798; 5,320,938; 5,356,764 and in WO 94/022051; in the published EP-A's 0 534 395, 0 569 971, 0 584 815, 0 584 644, 0 602 878, 0 616 255, 0 617 317, 0 617 320, 0 617 321, 0 617 325, 0 618 492 and in EP-A 0 653 669.

Otherwise tabular silver halide grains rich in chloride, bounded by {111} major faces and/or the preparation method thereof and/or materials in which said grains are incorporated have been described in e.g. U.S. Pat. Nos. 4,399,215; 4,400,463; 4,804,621; 5,061,617; 5,176,991; 5,176,992; 5,178,997; 5,178,998; 5,183,732; 5,185,239; 5,217,858; 5,221,602; 5,264,337; 5,272,052; 5,275,930; 5,286,621; 5,292,632; 5,298,385; 5,298,387; 5,298,388; 5,310,644; 5,320,938; 5,356,764; in the published EP-A's 0 481 133, 0 503 700, 0 532 801, 0 533 189, 0 647 877 and 0 678 772.

At least one of said tabular grains may further be doped with whatever a dope as e.g. with group VIII metal ions like $Rh^{3+}$, $Ir^{4+}$ and $Co^{2+}$ or with $Cd^{2+}$, $Zn^{2+}$ or $Pb^{2+}$ or even with a mixture thereof.

The crystal size obtained at the end of the precipitation of silver halide grains depends on many factors as there are the amount of silver precipitated during the nucleation step, the initial concentration of reagents present in the reaction vessel, the flow rate of silver salt and halide salt solutions, the temperature, pAg, the presence of growth accelerators, etc.

For tabular silver halide grains comprised in the silver halide photographic materials according to this invention an average thickness over the total crystal population of less than 0.2 $\mu$m is preferred. A thickness of less than 0.15 $\mu$m is even more preferred. Even ultrathin crystals of from 0.06 $\mu$m thickness can be used. The average aspect ratio, defined as the ratio, calculated from the measurements of the equivalent diameter of a circle having the same surface area as the different individual grains, and its thickness, is preferably higher than 5:1; more preferably higher than 8:1 and still more preferably higher than 12:1, up to about 100:1.

Mixtures of the tabular crystals rich in chloride having {111} and/or {100} major faces can also be used just as mixtures of silver bromide and/or bromoiodide tabular grains having {111} major faces.

In accordance with the present invention mixtures of emulsions described hereinbefore can be used in the adjacent layers of the photographic material according to this invention, with the proviso that the layer closest to the support contains a mixture of tabular grains, whereas the layer farther from the support contains a mixture of essentially cubic grains. A convincing example with an improved image tone for a layer arrangement wherein both adjacent layers contain silver bromide and/or silver bromoiodide emulsion crystals could not be obtained and is therefore absent in the Examples hereinafter. Such a layer arrangement in a photographic material is more suitable in order to provide increased sensitivity and maximum density (efficient use of silver) for unchanged coating amounts of silver if compared with a material having only one emulsion layer at one or both sides of a support as has been disclosed in EP-A 0 084 637.

Emulsions having a different halide distribution or composition can be mixed or emulsions having the same halide composition differing from one another in average crystal size. The said emulsions differing from each other in grain size having the same composition can be obtained from the same fine silver halide "mother" emulsion nuclei. By addition of different amounts of silver salt and halide salt solutions or by applying different physical ripening times such emulsions having crystals different in size can be obtained.

In one embodiment of the present invention at the end of the emulsion preparation process the emulsion is made free from excess of soluble inorganic salts by a conventional wash technique e.g. flocculation by ammonium sulphate or polystyrene sulphonate, followed by several washing steps and redispersion. Another well-known wash technique is ultrafiltration. Finally extra gelatin can be added to the emulsion in order to obtain the desired gelatin to silver ratio.

In accordance with the present invention the tabular silver halide emulsions in a hydrophilic layer closest to the support are chemically sensitized, whereas the essentially cubic emulsion(s) situated in an adjacent layer farther from the support, may be chemically sensitized, as in this multilayer composition the essentially cubic grains are not contributing to an increase of the sensitivity or speed of the material: the essentially cubic grains are preferably less sensitive than the tabular grains present in the adjacent layer(s) and are effective in order to obtain a suitable black image tone as is the object of this invention.

Chemical sensitization procedures are described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur, selenium or tellurium e.g. thiosulphate, thiocyanate, thioureas, selenosulphate, selenocyanate, selenoureas, tellurosulphate, tellurocyanate, sulphites, mercapto compounds, and rhodamines. The emulsions may be sensitized also by means of gold-sulphur ripeners or by means of reductors e.g. tin compounds as described in GB-Patent 789,823, amines, hydrazine derivatives, formamidine-sulphinic acids, and silane compounds.

Chemically sensitising can further proceed with sensitising agents well-known in the art. It can proceed by means of a reduction sensitizer, a noble metal salt such as a gold salt together with a reduction sensitizer, a sulphur and/or a selenium sensitizer, a high pH-value and a low pAg-value. A combination of gold salt(s), sulphur and selenium compounds can offer a good fog-sensitivity relationship. Reduction sensitization causing fog can e.g. be attained by reduction with a strong reducing agent which introduces small specks of metallic silver onto the silver halide crystals, preferably on those having a cubic habit. Examples of especially useful compounds having reducing properties are e.g. thioureumdioxide, tin compounds as described in GB-A 789,823, amines, hydrazine derivatives, formamidine-sulphinic acids and silane compounds and the like.

Whereas the essentially cubic silver chloride, silver chlorobromide or silver bromide emulsions may be spectrally sensitized or not, the tabular silver halide emulsion crystals having {100} or {100} major faces are spectrally sensitized for the same reason as set forth hereinbefore with respect to the chemical ripening, namely the main object to obtain a suitable black image tone. According to this invention said essentially cubic crystals don't contribute to speed or sensitivity and therefor are made less sensitive than the tabular grains present in the adjacent layer(s).

Spectral sensitization may proceed with methine dyes such as those described by F. M. Hamer in "The Cyanine Dyes and Related Compounds", 1964, John Wiley & Sons. Further a survey of useful chemical classes of spectral sensitising dyes and specific useful examples in connection with tabular grains is given in Research Disclosure Item 22534. Moreover a more recent practical overview is given in EP-Application No. 95202096, filed Aug. 1, 1995, which is incorporated herein by reference.

Dyes that can be used for the purpose of spectral sensitization include cyanine dyes, merocyanine dyes, complex cyanine dyes, complex merocyanine dyes, hemicyanine dyes, styryl dyes and hemioxonol dyes. Especially preferred green sensitizers e.g. in connection with the present invention are anhydro-5,5'-dichloro-3,3'-bis(n.sulfo-butyl)-9-ethyloxacarbo-cyanine hydroxide and anhydro-5,5'-dichloro-3,3'-bis(n.sulfo-propyl)-9-ethyloxacarbo-cyanine hydroxide. Other particularly valuable dyes as the already mentioned cyanine dyes, merocyanine dyes and complex merocyanine dyes are broadening the spectral region to which the light-sensitive silver halide crystals are sensitive in order to capture the light emitted from the light source, as non-spectrally sensitized silver halide crystals used in the process for preparing a multilayer material according to this invention are only sensitive in the ultraviolet and blue region of the spectrum. Preferably according to this invention the spectrum of the spectrally sensitized silver halide crystals is comprised between 350 and 500 nm.

As has already been suggested, in classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains. This may also be done with the emulsions of the present invention, wherein the chemical sensitization proceeds in the presence of one or more phenidone and/or derivatives, a dihydroxy benzene as hydroquinone, resorcinol, catechol and/or a derivative(s) therefrom, one or more stabilizer(s) or antifoggant(s), one or more spectal sensitizer(s) or combinations of said ingredients. Especially 1-p-carboxyphenyl, 4,4' dimethyl-3-pyrazolidine-1-one may be added as a preferred auxiliary agent.

Other dyes, which per se do not have any spectral sensitization activity, or certain other compounds, which do not substantially absorb visible radiation, can have a supersensitization effect when they are incorporated together with said spectral sensitising agents into the emulsion. Suitable supersensitizers are, i.a., heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and in U.S. Pat. No. 3,635,721, aromatic organic acid/formaldehyde condensation products as described e.g. in U.S. Pat. No. 3,743,510, cadmium salts, and azaindene compounds.

Depending on the application wherein the silver halide material according to this invention is used emulsions comprising silver halide crystals are spectrally sensitized in order to be sensitive to the light sources used, whether or not emitting visible radiation.

At least one non-spectrally sensitising dye can be added as a filter dye to at least one of the adjacent emulsion layers of the materials according to this invention, or to one or more non-light-sensitive hydrophilic layers. The presence of said dye(s) in adapted amounts in at least one hydrophilic layer is not only recommended to adjust the sensitivity of the different emulsion layers and eventually the required contrast, but also in order to reduce scattering of exposure radiation and thus to enhance sharpness. Preferred dyes are those that can be removed relatively easily in aqueous alkaline processing liquids and that can diffuse sufficiently fast throughout hydrophilic colloid layers in said processing. During coating of the hydrophilic layers comprising said dye(s), it is clear that said dye(s) should be non-diffusable. Examples of said dyes, without being limited thereto, are the dyes that have been described in e.g. U.S. Pat. Nos. 3,560,214, 3,647,460, 4,288,534, 4,311,787, 4,857,446 etc. Monomethine dyes have an absorption spectrum of which the maximum is in the shorter wavelength range of the visible spectrum so that normally a second filter dye is needed to block or absorb green light and even a third one to absorb radiations of longer wavelengths e.g. radiations in the red or even in the infrared region. Once a filter dye has been selected, the problem is how to get the filter dye in a coated layer so that all the requirements mentioned previously are met. One of the preferred possibilities is to make use of solid particle dispersions of water insoluble dyes as has been described in EP-A 0 384 633, EP-B 0 323 729, EP-B 0 274 723, EP-B 0 276 566, EP-A 0 351 593, EP-A's 0 586 748, 0 587 230 and 0 656 401 and in U.S. Pat. Nos. 4,900,653; 4,904,565; 4,949,654; 4,940,654; 4,948,717; 4,988,611; 4,803,150 and 5,344,749. Another possibility is to prepare said dyes in the form of a solid silica particle dispersion as disclosed in EP-A 569 074.

Still another possibility to obtain ultra fine dye dispersions consists in acidifying a slightly alkaline coating composition "in situ" just before coating it onto the supporting layer. It has been found that the application of this dosage technique allows us to obtain the dyes in a very fine solid particle form, homogeneously divided into the coated layer so that solid particles can hardly be observed even by means of microscopic techniques.

The non-diffusing dyes added to a hydrophilic layer of a photographic element as a solid particle has a mean diameter of less than 10 $\mu$m, more preferably less than 1 mm and still more preferably less than 0.1 $\mu$m.

At a pH of at least 10 the dispersed filter dyes are easily solubilized so that they are removed almost completely from a hydrophilic waterpermeable colloid layer of a photographic silver halide emulsion material by its common alkaline aqueous liquid processing and leave almost no residual stain. The presence of sulphite in the processing solution contributes to a more rapid discoloration of the filter dyes. The dye(s) incorporated in the emulsion layer(s) of the multilayer material prepared according with the present invention preferably have the general structure (I)

(I)

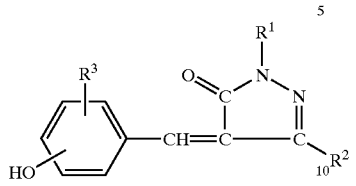

$R^1$ is hydrogen, alkyl, substituted alkyl, aryl, substituted aryl, aralkyl or substituted aralkyl, $R^2$ is carboxy, alkoxycarbonyl, aryloxycarbonyl, carbamoyl, ureido, sulphamoyl or one of the groups represented by $R^1$; at least one of $R^1$ and $R^2$ being or containing carboxy or carbamoyl, $R^3$ is hydrogen, $C^1$–$C^4$ alkyl or $C^1$–$C^4$ alkoxy, and when $R^3$ is alkyl or alkoxy it stands in ortho or para in respect of the hydroxy group, which itself is in ortho or para in respect of the methine group; said merostyryl dye containing further no group that renders the dye soluble in the hydrophilic colloid layer.

Although preferably present in at least one emulsion layer of the multilayer material according to this invention, the same or other dye(s) can be present in a backing layer, an antihalation undercoat layer, an intermediate layer and/or a protective outermost layer, depending on the requirements.

The silver halide emulsion for use in the multilayer material prepared according to the present invention may comprise compounds preventing the formation of a high minimum density or stabilising the photographic characteristics during the production or storage of photographic elements or during the photographic treatment thereof.

Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzo-triazole), nitrobenzotriazoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are those described in Research Disclosure No. 17643 (1978), Chaptre VI.

Fog-inhibiting agents or stabilizers can be added to the silver halide emulsion prior to, during, or after the ripening thereof and mixtures of two or more of these compounds can be used.

In the preparation of emulsions according to the present invention use can be made of a special oxidized gelatin or of a synthetic peptizer. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium. Additional gelatin is added in a later stage of the emulsion preparation e.g. after washing, to establish optimal coating conditions and/or to establish the required thickness of the coated emulsion layer.

Preferably a gelatin to silver halide weight ratio ranging from 0.3 to 1.0 is then obtained.

The gelatin binder of the photographic elements can be forehardened with appropriate hardening agents such as those of the epoxide type, those of the ethylenimine type, those of the vinylsulfone type, e.g., 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination.

The binder can also be hardened with fast-reacting hardeners such as carbamoylpyridinium salts as disclosed in U.S. Pat. No. 4,063,952 and with the onium compounds as disclosed in EP-A 0 408 143.

The photographic element of the present invention may comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805; 4,038,075 and 4,292,400.

The photographic element of the present invention may further comprise various other additives such as e.g. compounds improving the dimensional stability of the photographic element, UV-absorbers, spacing agents, hardeners, and plasticizers as described below.

Suitable additives for improving the dimensional stability of the photographic element may be added i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, a-b-unsaturated dicarboxylic acids, hydroxyalkyl (meth)acrylates, sulphoalkyl (meth)acrylates, and styrene sulphonic acids.

Plasticizers suitable for incorporation in the emulsions used according to the present invention are e.g. glycol, glycerine, or the latexes of neutral film forming polymers including polyvinylacetate, acrylates and methacrylates of lower alkanols e.g. polyethyl-acrylate and polybutyl-methacrylate.

Suitable UV-absorbers are i.a. aryl-substituted benzotriazole compounds as described in U.S. Pat. No. 3,533,794, 4-thiazolidone compounds as described in U.S. Pat. No. 3,314,794 and 3,352,681, benzophenone compounds as described in JP-B 80/012586, cinnamic ester compounds as described in U.S. Pat. No. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 $\mu$m and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl-cellulose hexahydrophthalate. Other suitable spacing agents have been described in U.S. Pat. No. 4,614,708.

The emulsion layers of the photographic element according to the present invention are forming a multilayer package. At least two emulsion layers coated adjacent to each other are present, the presence of just two adjacent emulsion layers however being preferred.

The multilayer material according to this invention may further comprise, in at least one of the two adjacent layers, a mixture of light-sensitive emulsions, having the crystal habit as set forth according to this invention. In a preferred embodiment the number of light-sensitive emulsions used in each emulsion layer in the light-sensitive silver halide photographic material according to this invention is kept to a minimum in order to make the manufacturing thereof simple and reproducible, further offering the possibility to obtain an extended latitude and an undisturbed, straight sensitometric curve. Differences in average grain size and halide composition of the crystals mixed in one layer or in adjacent layers may also be present but for reasons of reproducibility and consistency during manufacturing it is preferred to prepare only one emulsion, to divide said emulsion in different parts, to apply a different spectral and/or chemical ripening and mixing them together. Besides the light-sensitive emulsion layers the photographic material according to this invention contains several non-light-sensitive layers. Adjacent to the emulsion layer situated farthest from the support a protective layer is present, which is the topcoat layer if no afterlayer is present. Said topcoat layer may further be duplitized. For such complicated multilayer arrangements, it is recommended, from an economic point of view, to coat these layers simultaneously by means of the slide-hopper or slide-hopper curtain coating technique.

Said protective layer(s) and afterlayer may comprise various additives like surfactants, matting agents, lubricants, thickening agents, bactericides, antistatic agents, etc. To the protective topcoat layer(s) one or more hardening agents may be added, preferably just before coating said layer(s). The same hardeners can be used as summarized hereinbefore. Further one or more non-spectrally sensitising dyes can be added thereto, preferably during coating, in order to controll the sensitivity of the coated material.

One or more backing layers are present in order to prevent curling of the silver halide photographic material if said material is a single side coated material. Therefor the coating amount of gelatin and/or matting agent is optimized.

Advantages offered by the method to prepare a multilayer material according to this invention are related to the main object to obtain a suitable image tone. Further the coated amount of silver, expressed as the equivalent amount of silver nitrate, can be reduced to amounts of e.g. less than 12 $g/m^2$ and still more preferably from 3 to 10 $g/m^2$. Higher amounts are particularly preferred in materials showing a higher sensitivity. From an ecological point of view this measure offers the advantage of consuming less chemicals in the processing and during replenishment.

Further several light-insensitive layers besides a protective layer and optionally, one or more backing layers, may be one or more intermediate layers e.g. filter layers and even an afterlayer containing e.g. the hardening agent(s), the antistatic agent(s), filter dyes for safety-light purposes, etc.

The support of the photographic material may be opaque or transparent e.g. a paper support or resin support. When a paper support is used preference is given to one coated at one or both sides with an a-olefin polymer e.g. a polyethylene layer which optionally contains an anti-halation dye or pigment. It is also possible to use an organic resin support e.g. cellulose nitrate film, cellulose acetate film, poly(vinyl acetal) film, polystyrene film, poly(ethylene terephthalate) film, poly(ethylene naphthalate), polycarbonate film, polyvinylchloride film or poly-a-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material in connection with the present invention can be used in any type of photographic element, as e.g. a black-and-white photographic element, especially in low-speed photographic elements such as materials used for graphic applications, for micrographic applications as duplicating materials to provide copies from original images, etc.

However since it is the purpose to improve the image tone especially materials used for medical X-ray diagnostic purposes are envisaged. Multilayer photographic X-ray materials prepared by the method of this invention are double-side coated X-ray materials or single-side coated X-ray materials having coated on the side, opposite to the side of the support carrying the light-sensitive emulsion layers, at least one backing layer.

The photographic material according to the present invention can be image-wise exposed by any convenient radiation source in accordance with its specific application. In a preferred embodiment X-ray conversion screens are used in a film-screen system wherein X-rays are absorbed by phosphor particles coated in the phosphor layer(s) of the screen. Said X-rays are converted into radiation having a wavelength for which the silver halide crystals coated in the layers of the light sensitive silver halide film material has been made sensitive. In said film-screen system the screen(s) is(are) brought into intimate contact with each side of the film material having emulsion layers in order to obtain a good image quality, especially sharpness. Said film-screen system can be a symmetrical or an asymmetrical system. Symmetrical systems are well-known as these are characterized by the presence of the same emulsion layers and other auxiliary layers at both sides of the support, in contact with the same phosphor plates. Asymmetrical film-screen systems may be composed of identical emulsion layers at both sides of the support but different phosphor plates e.g. phosphor plates differing in phosphor composition, phosphor grain sizes or grain size distributions, phosphor coating amounts, etc., and combinations of all those measures, thus leading to different screen speeds. Examples thereof can be found in e.g. U.S. Pat. Nos. 1,925,546; 4,835,396; 5,069,982 and 5,259,016; in JP-A's 06/130575 and 06/130577 and in EP-A's 0 232 888 and 0 633 497. Asymmetrical film-screen systems may be composed of identical screens in contact with both film sides comprising emulsion layers having different sensitivities, due to different silver halide compositions of the respective layers, due to differences in silver halide grain size or grain size distribution, due to differences in coating amounts, etc., and combinations of all these measures, leading to different speeds and/or contrasts of the emulsion layers at both sides of the film support. Examples thereof can be found e.g. in U.S. Pat. Nos. 4,994,355; 5,021,327; 5,252,443; 5,380,636 and 5,399,470; in JP-B 77/018580; in JP-A's 04/235545; 04/125626 and 04/145427 and in EP-A's 0 440 367; 0 449 101 and 0 530 117. Further in a screen-film system, both films and screens may be asymmetrical as has been illustrated, e.g., in DE 1 000 687; in DD 00 237 010; in U.S. Pat. Nos. 4,978,599; 5,070,248; 5,238,795; 5,259,016; 5,354,648 and 5,380,636; and in EP-A's 0 384 634; 0 437 117; 0 524 650; 0 577 027; 0 581 065 and 0 627 744.

After exposure of the film, processing conditions and composition of processing solutions are dependent on the specific type of photographic material in which the tabular grains present in the multilayer material prepared according to the present invention are applied. For example, in a preferred embodiment of materials for X-ray diagnostic purposes, after exposure of the film-screen system by X-rays, said materials may be subjected to rapid processing conditions. Preferably an automatically operating processing apparatus is used provided with a system for automatic regeneration of the processing solutions. Forehardened material may be processed using one-part package chemistry or three-part package chemistry, depending on the processing application determining the degree of hardening required in said processing cycle.

The processing of the photographic elements prepared according to the method of this invention is normally characterized by the steps of developing, fixing, rinsing and drying and preferably proceeds within a total processing time of 30 to 210 s and more preferably from 38 to 90 s, depending on the type of material and the amount of silver coated therein. Any chemicals known in the art can be used depending on their composition and particular application. For producing a black-and-white image they are preferably processed in a conventional phenidone/hydroquinone or substituted phenidone/hydroquinone developing solution and a conventional sodium and/or ammonium thiosulphate containing fixing solution.

The following Examples are illustrating the invention, without however limiting it thereto.

EXAMPLES

Preparation of Emulsion Crystals

Preparation of Emulsion A (AgCl Cubic Crystals)

A silver chloride emulsion having a cubic habit was prepared by a double jet technique. The silver halide composition was 100 mole % of chloride and the average grain size was 0.55 μm using methionin as a grain growth accelerator in an amount of 37 g per 615 ml of starting volume in the vessel, containing 46 g of inert gelatin and 10 mmoles of sodium chloride at 60° C. Concentrated solutions of 1 l of $AgNO_3$ and NaCl, 3 N each, were run with the double jet technique at a rate of 20 ml per minute for the silver nitrate solution during 50 minutes and 20.83 ml per minute for the sodium chloride solution was during 48 minutes. After physical ripening during 15 minutes, pAg was about 7.9 and the flocculation procedure could begin: pH was adjusted at a value of 3.3 with sulphuric acid and 4.5 g of polystyrene sulphonic acid was added slowly in 2 minutes. The washing procedure was performed in a discontinuous way, adding 3 l of demineralized water, containing up to 8 mmole of sodium chloride per liter, until pAg was reaching a value of about 7.3. After addition of inert gelatin to a ratio of gelatin to silver nitrate in the emulsion of about 0.35, the emulsion was redispersed and was chemically ripened to an optimal fog-sensitivity relationship at 52° C., pAg having a value of about 6.95. Chemical ripening agents, besides gold (in an amount of 0.019 mmole pro mole silver) and sulphur (tetramethyl thiodithiocarboxylic acid diamide in an amount of 0.061 mmole), were toluene thiosulphonic acid and iodide ions, both being predigestion agents, in amounts of 0.02 and 8.6 mmoles respectively.

Preparation of Emulsion B (AgBr Cubic Crystals)

A silver bromide (100 mole % of bromide) emulsion having a cubic habit was prepared by a conventional single jet method in a vessel containing 40 g of phthaloyl gelatin. The ammoniacal silver nitrate solution was held at 42° C. as well as the emulsion vessel, containing the halide salts. At a constant rate of 300 ml per minute the precipitation time was ended after 10 minutes and followed by a physical ripening time of 40 minutes. After that time an additional amount of 20 g of gelatin was added. The obtained emulsion was of an average grain of 0.59 μm and contained approximately 90 g of silver nitrate per kg of the dispersion after addition of 3 moles of silver nitrate.

After addition of sulphuric acid to a pH value of 3.5 stirring was stopped and after sedimentation the supernatant liquid was removed. The washing procedure was started after a scrape-rudder was installed and after addition of polystyrene sulphonic acid in the first turn to get a quantitative flocculate without silver losses. During the redispersion of the emulsion 150 g of gelatin were added so that the weight ratio of gelatin to silver nitrate was 0.42, the emulsion containing an amount of silver bromoiodide equivalent with 190 g of silver nitrate per kg. The emulsion was chemically ripened with sulphur and gold at 47° C. for 4 hours to get an optimized relation between fog and sensitivity and was further stabilized with 4-hydroxy-6-methyl-1,3,3a-tetrazaindene.

Preparation of Emulsion C (AgCl {111} Tabular Crystals)

A silver chloride emulsion having a {111} tabular habit was prepared as follows:

- 3 l of a dispersion medium (C) containing 0.444 moles of sodium chloride, 75 g of inert gelatin and 36 mg of adenine; the temperature was established at 45° C. and pH was adjusted to 6.0.
- a 2.94 molar silver nitrate solution (A);
- a solution containing 4.476 moles of sodium chloride and 42 mg of adenine (B1);

A nucleation step was performed by introducing solution A and solution B1 simultaneously in dispersion medium C both at a flow rate of 60 ml/min during 30 seconds. After a physical ripening time of 20 min during which the temperature was raised to 70° C. Then a growth step was performed by introducing by a double jet during 77.5 minutes solution A starting at a flow rate of 5 ml/min and linearly increasing the flow rate to an end value of 20 ml/min, and solution B1 at an increasing flow rate in order to maintain a constant pAg of 7.25. After cooling to about 40° C. the pH value of the said dispersing medium was adjusted to a value of 3.0 with sulphuric acid, and after the addition of 55.5 ml of polystyrene sulphonic acid the obtained flocculate was decanted and washed three times with an amount of 6 l of demineralized water in order to remove the soluble salts present. To this dispersion medium, after addition of 50 g of inert bone gelatin an amount of 1.25 mmole per mole of silver chloride was added of the dye anhydro-5,5'-dichloro-3,3'-bis-(n-sulphobutyl)-9-ethyloxacarbo-cyanine hydroxide.

Tabular silver chloride crystals having {111} major phase and a sphere equivalent average diameter of 2 μm were obtained, with an average thickness of 0.15 μm resulting in an average aspect ratio of 13. Before the start of the chemical ripening the pAg was adjusted to 7.25 and the pH-value to 5.5. Chemical ripening agents were gold thiocyanate, sodium thiosulphate as a source of sulphur and toluene thiosulphonic acid was used as predigestion agent. An optimal fog-sensitivity relationship was reached after 2 hours at 57° C. The emulsion was stabilized with 1-p-carboxy-phenyl-5-mercaptotetrazole.

Preparation of Emulsion D (AgCl {100} Tabular Crystals)

The following solutions were prepared:

- 2 l of a dispersion medium (C) containing 20 mmoles of sodium chloride and 10 g of inert bone gelatin; temperature was established at 50° C. and pH was adjusted to 6.0;
- a 2.94 molar silver nitrate solution (A);
- a 2.94 molar sodium chloride solution (B1). The temperature of A and B1 was established at 40° C.

A nucleation step was performed by introducing solution A and solution B1 simultaneously in dispersion medium C both at a flow rate of 60 ml/min during 30 seconds. After a physical ripening time of 20 min during which the temperature was raised to 70° C. Then a growth step was performed by introducing by a double jet during 64 minutes and 40 seconds solution A starting at a flow rate of 5 ml/min and linearly increasing the flow rate to an end value of 25 ml/min, and solution B1 at an increasing flow rate in order to maintain a constant pAg of 6.75. After cooling to about 40° C. the pH value of the said dispersing medium was adjusted to a value of 3.0 with sulphuric acid, and after the addition of 37 ml of polystyrene sulphonic acid the obtained flocculate was decanted and washed three times with an amount of 6 l of demineralized water in order to remove the soluble salts present.

The thus obtained silver chloride tabular emulsion showed {100}-major faces. The average circle equivalent diameter $d^{EM}$, average thickness d, average aspect ratio AR were obtained from electron microscopic photographs. Respective values of 1.58 μm; 0.42 μm and 3.8:1 were measured. The emulsion was redispersed and was chemically ripened to an optimal fog-sensitivity relationship at 52° C., pAg having a value of about 7.2. Chemical ripening agents, besides gold (in an amount of 0.019 mmole pro mole silver) and sulphur (tetramethyl thiodithiocarboxylic acid diamide in an amount of 0.061 mmole), were toluene thiosulphonic acid and iodide ions, both being predigestion agents in amounts of 0.021 and 8.6 mmoles respectively.

Example 1

This example demonstrates the improvement of image tone of the developed silver for AgCl {111} tabular crystals if they are combined with AgCl cubic crystals, present in the adjacent emulsion layer.

The coatings were prepared as follows: On a substrated blue polyester support of 175 μm thickness, each side was coated by means of the slide hopper technique with emulsion A, B or C, according to table I, in such way that each side contained 10.5 g/m$^2$ of silver halide, expressed as g $AgNO_3$/m$^2$, and 5.25 g/m$^2$ of gelatin.

For coating 4, a 50:50 mixture was taken of emulsions A and C, in such way that the total amount of silver halide coated on each side of said support was equivalent with 10.5 g $AgNO_3$/m$^2$.

For coating 5, an equivalent amount of 5.25 g of $AgNO_3$/m$^2$ of the tabular AgCl {111} emulsion (emulsion C) was coated on both sides of the support. Above each layer of the AgCl {111} tabular emulsion, an equivalent amount of 5.25 g of $AgNO_3$/m$^2$ of the cubic AgCl emulsion (emulsion A) was coated.

For the 5 coatings, on each side a protective layer was added wich contained 1.4 g/m$^2$ gelatin and which was hardened with formaldehyd and resorcinal to such an exent that when immersed in demineralized water of 24° C. for 10 minutes about 2 g of water was absorbed per g of gelatin.

Samples of these coatings were exposed with a 235 kV radiation source placed at a distance of 1.50 m in contact with a copper filter of 8 mm thickness. The samples (coatings 2 to 5) were processed for 35 seconds at 25° C. in a developer having the following composition:

| | |
|---|---|
| Hydroquinone | 0.18 mole/l |
| 1-phenyl-4-methyl-3-pyrazolidine-1-one | 4.6 mmole/l |
| $Br^-$ | 21 mmole/l |
| $SO_3^{--}$ | 0.19 mole/l |
| $CO_3^{--}$ | 0.44 mole/l |
| Polyglycol (M.W. = ca. 400) | 20 ml/l |
| $SCN^-$ | 25.7 mmole/l |
| Ascorbic Acid | 0.11 mole/l |
| pH ready-for-use: | 10.0. |

The comparative coating 1 was processed in G135, a developer marketed by Agfa-Gevaert N.V., for 2 minutes at 25° C. The hue of the developed silver was evaluated qualitatively and quantitatively:

a. Qualitatively: A visual comparison was made by comparing in reflection the obtained "HUE" with the "HUE" of a standard at a density of 2.5. Figures were given from "1" (brown) to "5" (black). The higher the figure, the more preferred is the image tone of the developed silver. This method evaluates the reflection characteristics of the hue of the developed material.

b. Quantitatively: The ratio of the densities obtained by measurement of the said densities at total density 2.5 through a filter transparent for blue and red light respectively, was calculated. The lower this ratio value "DBR", the more preferred is the image tone of the developed silver. This method evaluates the transmission characteristics of the hue of the developed material. Table I demonstrates the results obtained by coating a layer more close to the support comprising AgCl {111} tabular grains and adjacent and on top thereto a layer comprising AgCl cubic grains (SENS is the relative sensitivity measured at a density of 2.0 above the fog level).

TABLE I

| Coating | Layer most close to the support | Layer farthest from the support | SENS | HUE | DBR |
|---|---|---|---|---|---|
| 1 (ref.) | AgBr cubic grain (Emulsion B) | | 100 | 3.5 | 0.976 |
| 2 (comp.) | AgCl {111} tabular grain (Emulsion C) | | 156 | 1 | 0.996 |
| 3 | AgCl cubic grain (Emulsion A) | | 106 | 5 | 0.939 |
| 4 | AgCl cubic + AgCl {111} tabular grain (Emulsion A + C) | | 123 | 3 | 0.980 |
| 5 (inv.) | AgCl {111} tabular grain (Emulsion C) | AgCl cubic grain (Emulsion A) | 129 | 4.5 | 0.965 |

The following conclusions can be drawn from Table I. As is well-known to those skilled in the art, a material comprising tabular {111} AgCl grains is a very good alternative for the one containing AgBr cubic grains, because of the high sensitivities that can be obtained with said tabular {111} AgCl grains. However, as can be seen from Table I, the developed AgCl {111} tabular grains show a very brownish hue in reflection and transmission (coating 2).

In most cases AgCl cubic grains offer less speed (lower sensitivity) than AgCl {111} tabular grains and are therefor less suited to replace AgBr cubic grains. However, as can be seen from Table I, the observed reflective hue for the developed AgCl cubic grains is black, and even better than the reflective hue of the developed AgEr cubic grains (coating 3).

If the AgCl {111} tabular grains are combined with the AgCl cubic grains in one layer, a sensitivity in between the sensitivities obtained for each emulsion if coated alone is found. A reflective and transmissive hue in between the two separately coated grains is also found (coating 4).

If the AgCl cubic emulsion is coated above the AgCl {111} tabular emulsion (coating 5), the reflective hue for the developed material is improved if compared with the layer wherein a mixture of the cubic and tabular AgCl emulsion is made. The sensitivity remains practically constant. Most strikingly, also the transmissive hue (DBR) is improved.

Example 2

This example demonstrates the improvement of the image tone of the developed silver for AgCl {111} tabular crystals if they are coated in a layer closer to the support, overcoated with an adjacent layer comprising AgCl cubic crystals. Moreover less silver per square meter is coated.

The coatings were prepared as follows:

The emulsions A and C were optimally spectral sensitized with a mixture of the dye anhydro-5,5'-dichloro-3,3'-bis(n-sulphobutyl)- 9-ethyloxacarbo-cyanine hydroxide and the dye anhydro-5,5'-di-phenyl-3,3'-bis(n-sulphobutyl)-9-ethyloxacarbo-cyanine hydroxide and further stabilized with an optimally chosen mixture of 1-phenyl-5—mercaptotetrazole and 1-p-carboxy-phenyl-5-mercaptotetrazole. On a substrated polyethylene terephtalate film support having a thickness of 175 μm, each side was coated by means of the slide hopper technique with emulsion A and/or C, according to Table II, in such a way that each side contained 3.5 g/m$^2$, expressed in g of the equivalent amount of $AgNO_3$/m$^2$, and 1.25 g/m$^2$ gelatin.

For coating 8, a 50:50 mixture was taken of emulsion A and C, in such way that the total amount of coated emulsion on each side was corresponding with an equivalent amount of 3.5 g of $AgNO_3$/m$^2$.

For coating 9, on both sides of the support an equivalent amount of 1.75 g $AgNO_3$/m$^2$ was coated of the AgCl {111} tabular emulsion (emulsion C). Above each layer comprising the AgCl {111} tabular emulsion grains, an equivalent amount of 1.75 g $AgNO_3$/m$^2$ of the AgCl cubic emulsion (emulsion A) was coated.

For the 4 coatings (6 to 9) a protective layer was added at each side of the support. Said protective layer was containing 1.4 g/m$^2$ of gelatin and was hardened with formaldehyd and resorcinal to such an exent that when immersed in demineralized water of 24° C. for 10 minutes about 0.3 g of water was absorbed per g of gelatin. Samples of these coatings were exposed with green light of 540 nm during 0.1 second using a continuous wedge and were processed for 22" at 33° C. in G138, a developer marketed by Agfa-Gevaert N.V. The hue of the developed silver was evaluated qualitatively and quantitatively as has been described in Example 1. Results are shown in Table II.

TABLE II

| Coating | Layer closer to the support | Layer farther from the support | HUE | DBR |
|---|---|---|---|---|
| 6 (comp.) | AgCl {111} tabular grain (Emulsion C) | | 1 | 1.012 |
| 7 | AgCl cubic grain (Emulsion A) | | 5 | 0.890 |
| 8 | AgCl cubic + AgCl {111} tabular grain (Emulsion A + C) | | 2 | 0.960 |
| 9 (inv.) | AgCl {111} tabular grain (Emulsion C) | AgCl cubic grain (Emulsion A) | 3 | 0.950 |

As can be seen from the Table II the hue of a mixed layer of a {111} tabular AgCl emulsion and a cubic AgCl emulsion can be improved both in reflection and transmission if the two emulsions are coated in adjacent layers with the cubic emulsion on top of both.

Example 3

This example demonstrates that the same favorable effect as illustrated hereinbefore is obtained if a {100} tabular AgCl emulsion is used instead of a {111} tabular AgCl emulsion.

The coatings were prepared as follows:

The emulsions A and D were optimally spectral sensitized with a mixture of the dye anhydro-5,5'-dichloro-3,3'-bis(n-sulphobutyl)-9-ethyloxacarbo-cyanine hydroxide and the dye anhydro-5,5'-di-phenyl- 3,3'-bis(n-sulphobutyl)-9-ethyloxacarbo-cyanine hydroxide and further stabilized with an optimal mixture of 1-phenyl-5-mercaptotetrazole and 1-p-carboxy-phenyl-5-mercaptotetrazole.

On a substrated polyethylene terephtalate film support having a thickness of 175 μm, each side was coated by means of the slide hopper technique with emulsion A and/or D, according to the data given in Table III hereinafter, in such way that each side was containing 3.5 g/m$^2$, expressed as the equivalent amount of $AgNO_3$/m$^2$ and 1.25 g/m$^2$ gelatin.

For coating 12, a 50:50 mixture was taken of emulsion A and D, in such way that the total amount of emulsion coated on each side was equal to an equivalent amount of 3.5 g of $AgNO_3$/m$^2$. For coating 13, an equivalent amount of 1.75 g $AgNO_3$ /m$^2$ of the AgCl {100} tabular emulsion (emulsion D) was coated on both sides of the support. Above each layer of the AgCl {100} tabular emulsion, an equivalent amount of 1.75 g $AgNO_3$/m$^2$ of the AgCl cubic emulsion (emulsion A) was coated.

For the 4 coatings (10 to 13), a protective layer was coated on each side. Each of said layer was containing 1.4 g/m$^2$ of gelatin and was hardened with formaldehyd and resorcinal to such an exent that when immersed in demineralized water of 24° C. for 10 minutes about 0.3 g of water was absorbed per g of gelatin.

Samples of these coatings were exposed and developed as has been described in Example 2.

The hue of the developed silver was evaluated qualitatively and quantitatively as has been described in Example 1.

The results are shown in table III.

As can be seen from Table III the hue of a mixed layer of a {100} tabular AgCl emulsion and a cubic AgCl emulsion can be improved both in reflection and transmission if the two emulsions are coated in adjacent layers with the cubic emulsion on top.

TABLE III

| Coating | Layer closer to the support | Layer farther from the support | HUE | DBR |
|---|---|---|---|---|
| 10 (comp.) | AgCl {100} tabular grain (Emulsion D) | | 3 | 0.990 |
| 11 | AgCl cubic grain (Emulsion A) | | 5 | 0.890 |
| 12 | AgCl cubic + AgCl {100} tabular grain (Emulsion A + D) | | 4 | 0.942 |
| 13 (inv.) | AgCl {100} tabular grain (Emulsion D) | AgCl cubic grain (Emulsion A) | 4.5 | 0.910 |

Example 4

This example demonstrates that the same favorable effect as mentioned hereinbefore is obtained in a multilayer material comprising in a layer closer to the support a {100} tabular AgCl emulsion and in a layer adjacent thereto and on top of it a layer comprising a AgBr cubic emulsion.

The coatings were prepared as follows:

Emulsion B was optimally spectral sensitized with the dye anhydro-5,5'-dichloro-3,3'-bis(n-sulphobutyl)-9-ethyloxacarbo-cyanine hydroxide and further stabilized with 4-hydroxy-6-methyl-1,3,3a-tetrazaindene.

Emulsion D was optimally spectral sensitized and further stabilized as has been described in example 3.

On a substrated polyethylene terephtalate film support of 175 μm thickness, each side was coated by means of the slide hopper technique with emulsion B and/or D, according to table IV, in such way that each side contained 3.5 g/m$^2$, expressed as g $AgNO_3$/m$^2$, and 1.25 g/m$^2$ gelatin.

For coating 16, a 50:50 mixture was taken of emulsion B and D, in such way that the total amount of emulsion coated on each side was equivalent with an amount of 3.5 g of $AgNO_3$/m$^2$.

For coating 13, an equivalent amount of 1.75 g $AgNO_3$/m$^2$ of the AgCl {100} tabular emulsion (emulsion D) was coated on both sides of the support. Adjacent thereto on top of the said layers comprising the AgCl {100} tabular emulsion, an equivalent amount of 1.75 g of $AgNO_3$/m$^2$ of the AgBrI cubic emulsion (emulsion B) was coated.

For the 4 coatings (14 to 17), on each side of the support a protective layer was added wich contained 1.4 g/m$^2$ of gelatin and was hardened with formaldehyd and resorcinal to such an exent that when immersed in demineralized water of 25° C. for 3 minutes about 0.3 g of water was absorbed per g of gelatin.

Samples of these coatings were exposed and developed as has been described in Example 2.

The hue of the developed silver was evaluated qualitatively and titatively as has been described in Example 1.

The results are shown in table IV.

TABLE IV

| Coating | Layer closer to the support | Layer farther from the support | HUE | DBR |
|---|---|---|---|---|
| 14 (comp.) | AgCl {100} tabular grain (Emulsion D) | | 3 | 0.990 |
| 15 | AgBr cubic grain (Emulsion B) | | 4.5 | 0.971 |
| 16 | AgBr cubic + AgCl {100} tabular grain (Emulsion B + D) | | 3.5 | 0.964 |
| 17 (inv.) | AgCl {100} tabular grain (Emulsion D) | AgBr cubic grain (Emulsion B) | 4 | 0.960 |

As can be seen from table IV the hue of a layer coated from a mixture of an {100} tabular AgCl emulsion and a cubic AgBr emulsion can be improved both in reflection and transmission if the two emulsions are coated in layers adjacent to each other, with the cubic emulsion on top.

What is claimed is:

1. A multilayer light-sensitive silver halide photographic negative image type material comprising on at least one side of a support a multilayer composition of at least two layers of negative image type silver halide emulsions adjacent to each other, wherein the emulsion layer more close to the said support comprises at least one emulsion having tabular emulsion crystals selected from the group consisting of silver chloride, silver chlorobromide, silver chloroiodide and silver chlorobromoiodide having a {111} crystal habit and silver chloride, silver chlorobromide, silver chloroiodide and silver chlorobromoiodide having a {100} crystal habit, wherein the adjacent layer(s) farther from the said support comprise(s) at least one emulsion having essentially cubic emulsion crystals selected from the group consisting of a silver chloride, silver chlorobromide and silver bromide, wherein the said tabular silver chloride, silver chlorpbromide, silver chloroiodide or silver chlorobromoiodide emulsion crystals having {111} or {100} major faces have at least 50 mole % of chloride and wherein the essentially cubic grains are less sensitive than the tabular grains.

2. Material according to claim 1, wherein the said tabular silver chloride, silver chlorobromide, silver chloroiodide or silver chlorobromoiodide emulsion crystals having {111} or {100} major faces have at least 75 mole % of chloride.

3. Material according to claim 1, wherein said tabular {111} or {100} silver halide emulsion crystals containing iodide have an iodide content from 0.1 to 3 mole %.

4. Material according to claim 1, wherein said tabular silver halide emulsions have an average aspect ratio of at least 5:1, an average grain thickness of less than 0.2 μm and wherein the tabular grains present in said emulsions account for at least 50% of the total projected area of the said grains.

5. Material according to claim 1, wherein said tabular silver halide emulsions have an average aspect ratio of at least 8:1, an average grain thickness of less than 0.2 μm and wherein the tabular grains present in said emulsions account for at least 50% of the total projected area of the said grains.

6. Material according to claim 1, wherein the said essentially cubic emulsion crystals have an average crystal diameter of from 0.1 to 0.8 μm.

7. Material according to claim 1, wherein the said essentially cubic emulsion crystals have an average crystal diameter of from 0.2 to 0.6 μm.

8. Material according to claim 1, wherein said material is a double-side coated X-ray material.

9. Material according to claim 1, wherein said material is a single-side coated X-ray material having coated on the side, opposite to the side of the support carrying the light-sensitive emulsion layers, at least one backing layer.

10. Method for preparing a multilayer light-sensitive silver halide photographic negative image type material according to claim 1 by the steps of coating on at least one side of a support a multilayer composition as defined in the said claim 1 and overcoating said composition(s) with at least one protective layer.

* * * * *